US012637123B2

(12) United States Patent
Goerlich et al.

(10) Patent No.: US 12,637,123 B2
(45) Date of Patent: May 26, 2026

(54) SPEED AND TRACTION CONTROL SYSTEM FOR RAIL VEHICLES

(71) Applicant: STEWART & STEVENSON LLC, Houston, TX (US)

(72) Inventors: Jesse Goerlich, Houston, TX (US); Rogelio Rios, Houston, TX (US)

(73) Assignee: STEWART & STEVENSON LLC, Houston, TX (US)

( * ) Notice: Subject to any disclaimer, the term of this patent is extended or adjusted under 35 U.S.C. 154(b) by 64 days.

(21) Appl. No.: 18/917,383

(22) Filed: Oct. 16, 2024

(65) Prior Publication Data

US 2025/0171060 A1 May 29, 2025

Related U.S. Application Data

(60) Provisional application No. 63/604,018, filed on Nov. 29, 2023.

(51) Int. Cl.
*B61L 15/00* (2006.01)

(52) U.S. Cl.
CPC ..... *B61L 15/0062* (2024.01)

(58) Field of Classification Search
CPC ..... B61L 15/0062; B60F 1/005
See application file for complete search history.

(56) References Cited

U.S. PATENT DOCUMENTS 4,459,668 A * 7/1984 Inoue ..... B61L 15/0062 246/182 B
8,424,387 B2 * 4/2013 Wigh ..... G01N 29/043 73/644
11,155,135 B2 * 10/2021 Blouin ..... B61C 15/12
11,396,254 B2 * 7/2022 Lang ..... B60F 1/00

* cited by examiner

*Primary Examiner* — Sizo B Vilakazi
(74) *Attorney, Agent, or Firm* — Ewing & Jones, PLLC

(57) ABSTRACT

The present disclosure provides for a railroad car moving vehicle. The railroad car moving vehicle includes a chassis frame and a platform, the platform mechanically connected to the chassis frame. The railroad car moving vehicle also includes flanged rail wheels, the flanged rail wheels coupled to the chassis frame and a cab, the cab positioned on the platform. The railroad car moving vehicle also includes a rail idler wheel, the rail idler wheel connected to the chassis frame. The rail idler wheel includes a wheel and an encoder, the encoder in electrical communication with the wheel. In addition, the rail idler wheel includes a support system, the support system mounting the wheel to the chassis frame, and a control system, the control system in electrical communication with the encoder.

14 Claims, 4 Drawing Sheets

SPEED AND TRACTION CONTROL SYSTEM FOR RAIL VEHICLES

CROSS-REFERENCE TO RELATED APPLICATIONS

This application is a nonprovisional application which claims priority from U.S. provisional application No. 63/604,018, filed Nov. 29, 2023, which is incorporated by reference herein in its entirety.

TECHNICAL FIELD/FIELD OF THE DISCLOSURE

The present disclosure relates generally to rail vehicles.

BACKGROUND OF THE DISCLOSURE

Railroad car moving vehicles are used for moving railroad cars without the need for locomotives. Such vehicles are capable of operating both on the railroad track for the moving of railroad cars or on the ground for moving the railroad car moving vehicle between railroad tracks. Such a vehicle is sometimes referred to as a rubber-rail car. When the railroad car moving vehicle is operated on the railroad track, the rubber-tired ground wheels are retracted to a position above the rails on each side of the vehicle. When the track wheels are no longer required, the ground wheels are lowered and locked in place so that the vehicle can travel over the ground.

SUMMARY

The present disclosure provides for a railroad car moving vehicle. The railroad car moving vehicle includes a chassis frame and a platform, the platform mechanically connected to the chassis frame. The railroad car moving vehicle also includes flanged rail wheels, the flanged rail wheels coupled to the chassis frame and a cab, the cab positioned on the platform. The railroad car moving vehicle also includes a rail idler wheel, the rail idler wheel connected to the chassis frame. The rail idler wheel includes a wheel and an encoder, the encoder in electrical communication with the wheel. In addition, the rail idler wheel includes a support system, the support system mounting the wheel to the chassis frame, and a control system, the control system in electrical communication with the encoder.

The present disclosure also provides for a method of controlling the speed of a railroad car moving vehicle. The method includes supplying a railroad car moving vehicle, the railroad car moving vehicle including a chassis frame and flanged rail wheels, the flanged rail wheels coupled to a transmission drive train. The railroad car moving vehicle also includes a rail idler wheel, the rail idler wheel connected to the chassis frame, the rail idler wheel including a wheel and an encoder, the encoder in electrical communication with the wheel. The rail idler wheel also includes a control system, the control system in electrical communication with the encoder. The method also includes measuring the revolutions per minute (RPM) of the wheel and measuring the transmission drive speed (TDS). The method also includes implementing RPM control. In a first option, the method includes comparing a maximum speed to the RPM of the wheel and if the RPM of the wheel is above the maximum speed, reducing an engine RPM until RPM of the wheel is less than maximum speed. The first option also includes, if TDS and RPM of the wheel differ, decreasing engine RPM until convergence of TDS and RPM of the wheel is met. In a second option, the method includes computing TDS acceleration from TDS, computing acceleration of RPM of the wheel, and comparing TDS acceleration and acceleration of RPM of the wheel. The second option also includes if TDS acceleration and acceleration of RPM of the wheel are different, reducing the TDS RPMs until TDS acceleration and RPM acceleration have converged.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
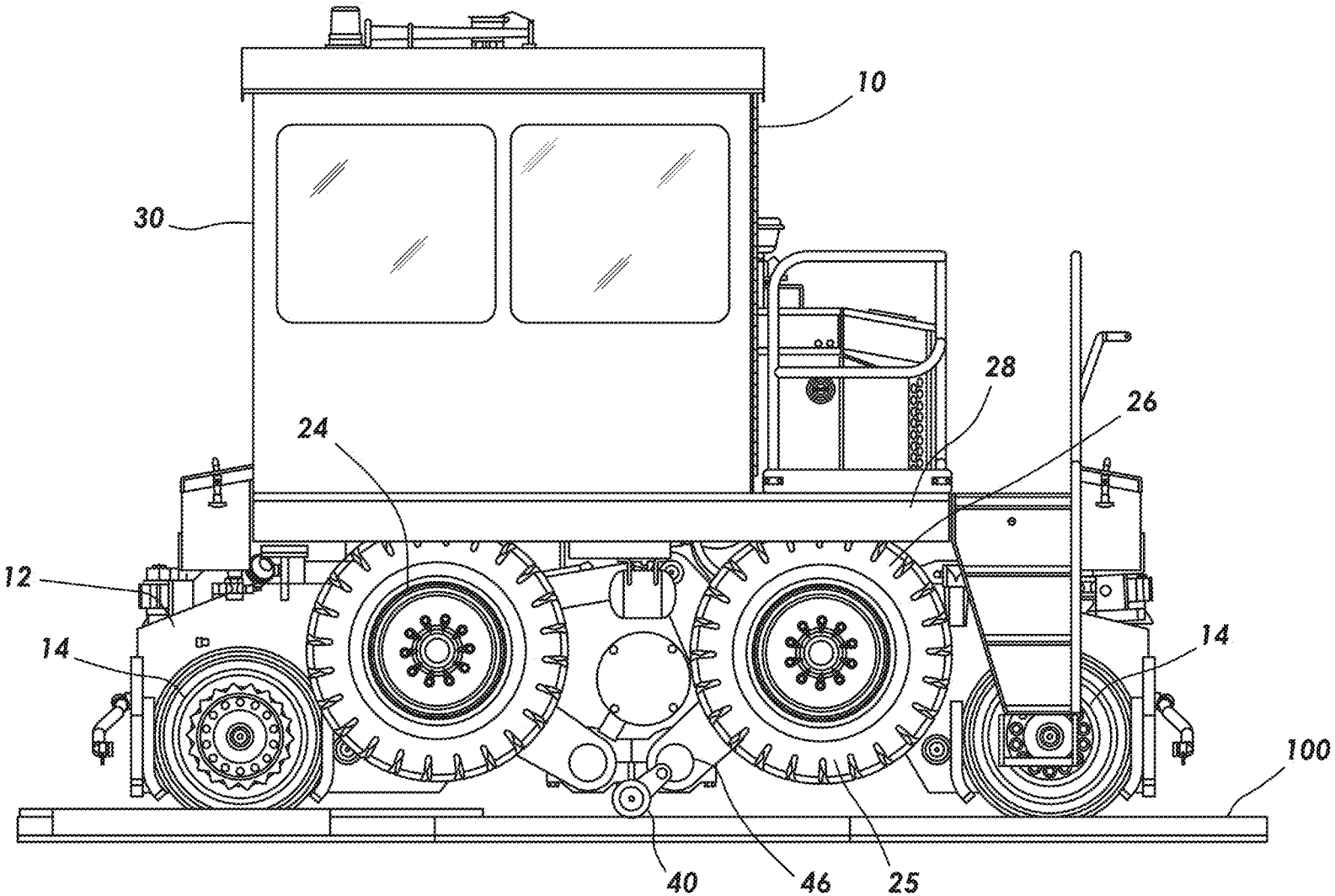
FIG. 1 is a side view of a railroad car moving vehicle consistent with certain embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a side view of railroad car moving vehicle 10 consistent with at least one embodiment of the present disclosure. Railroad car moving vehicle 10 may include chassis frame 12 and platform 28, wherein chassis frame 12 and platform 28 are mechanically connected. In some embodiments, flanged rail wheels 14 may be mechanically coupled to chassis frame 12 for use when railroad car moving vehicle 10 is operated on a railroad track. In some embodiments, ground wheel sets 24 and 26 may be coupled to chassis frame 12 for use when railroad car moving vehicle 10 is operated on the ground. Ground wheel sets 24, 26 may include tires 25, such as pneumatic rubber tires or foam filled tires, which may be raised and lowered hydraulically by hydraulic cylinders mounted on chassis frame 12. In some embodiments, cab 30 and other equipment may be positioned on platform 28.

When towing a mobile load, traction for flanged rail wheels 14 on a surface of the rail is used. For railroad car moving vehicle 10, traction may be created through a combination of: weight upon the rail, the torque of the power train, and surface friction. Sand, crushed glass, or other similar ground additives are commonly used to increase friction.

Figure 2:
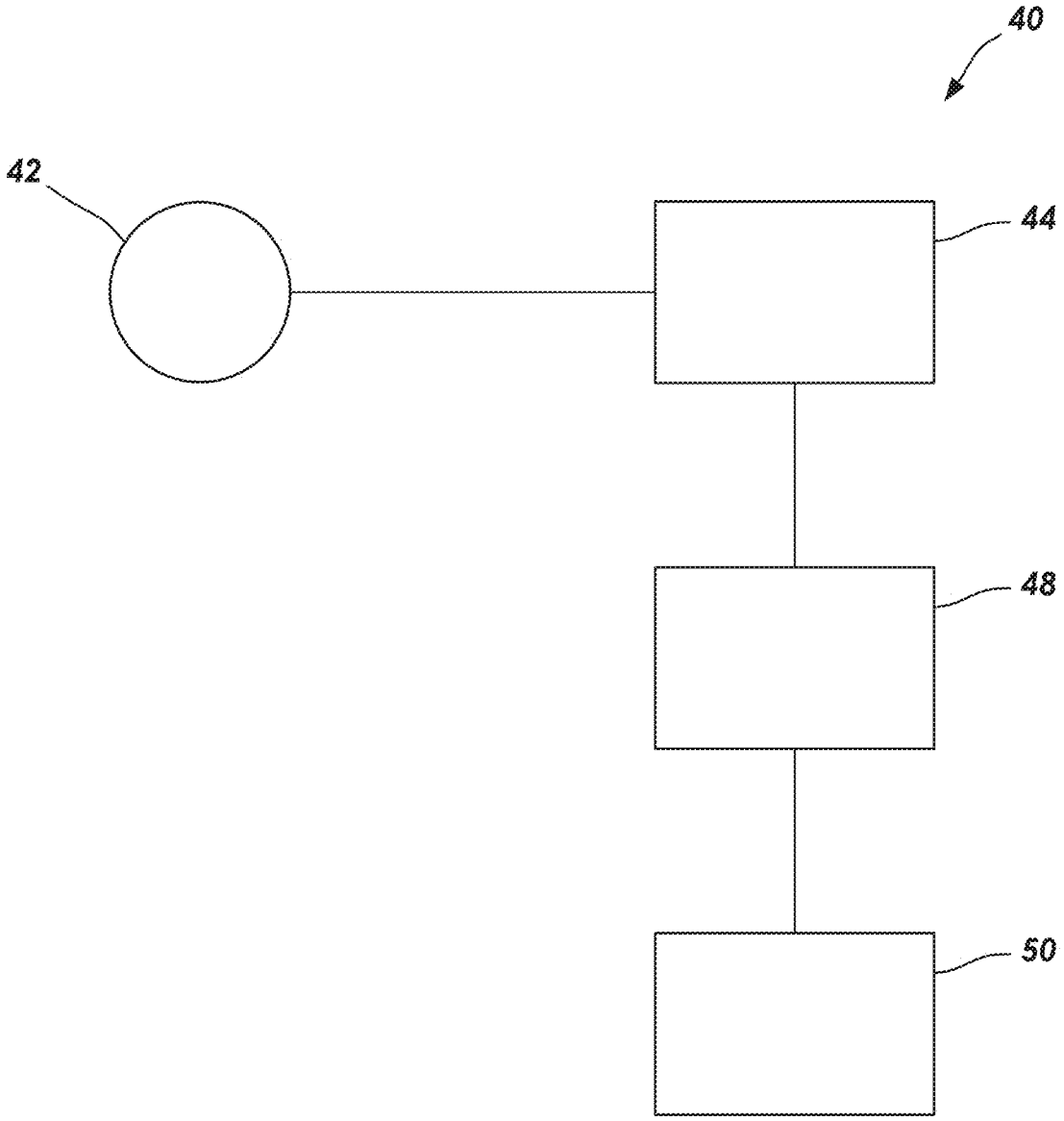
FIG. 2 is a schematic depiction of a rail idler wheel consistent with certain embodiments of the present disclosure.
Figure 4:
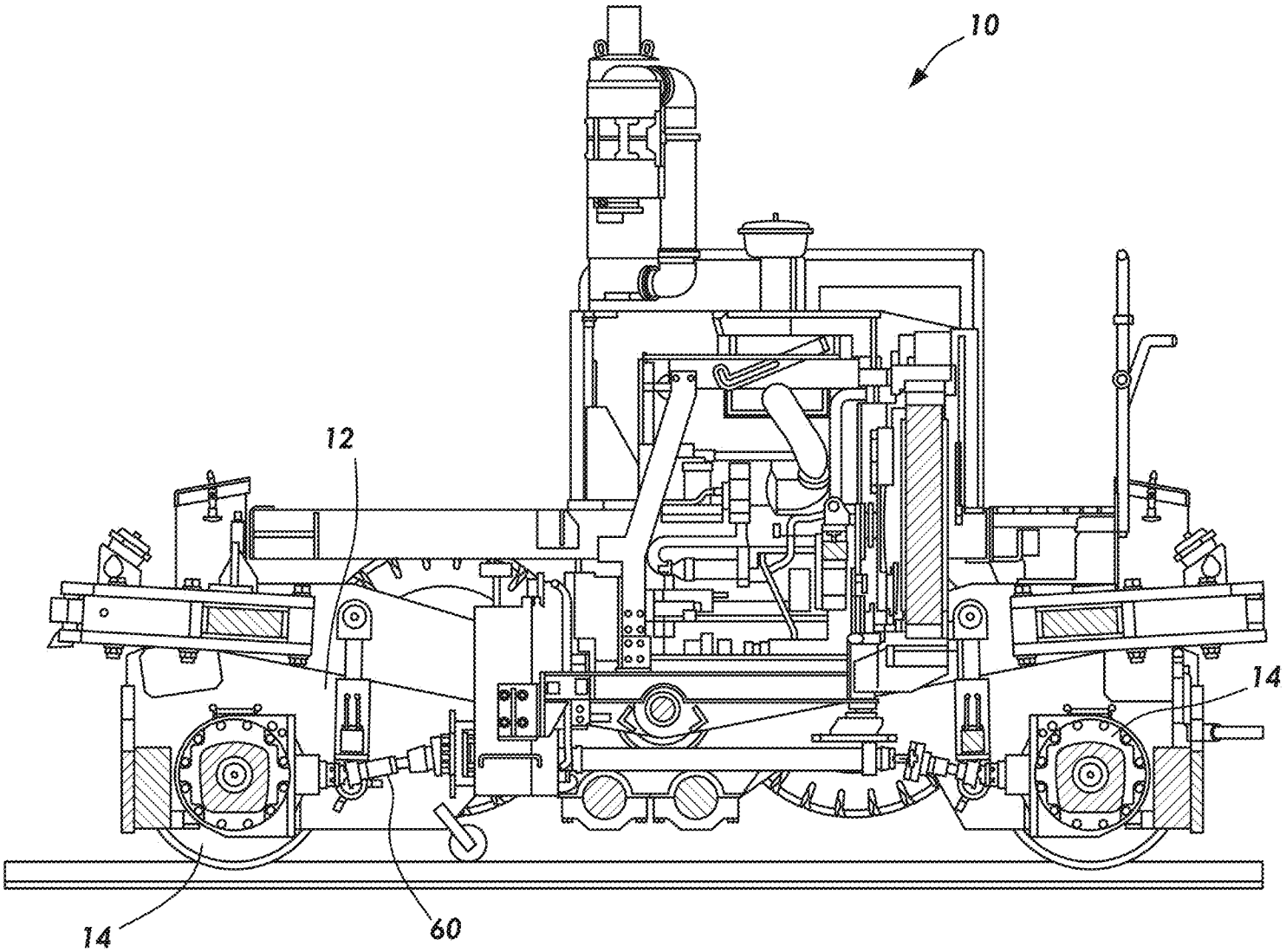
FIG. 4 is a cutaway side view of a railroad car moving vehicle consistent with certain embodiments of the present disclosure.

In certain embodiments, railroad car moving vehicle 10 may include rail idler wheel 40, as shown in FIG. 1. Rail idler wheel 40 may be connected to chassis frame 12 and includes, in part, wheel 42, which idles along rail 100. Rail idler wheel 40, as shown in FIG. 2, further includes encoder 44 in electrical communication with wheel 42, where encoder 44 captures the speed (in rotations per unit of time) of wheel 42 during travel. In addition, as shown in FIG. 1, rail idler wheel 40 may include support system 46 that mounts to chassis frame 12. Rail idler wheel 40 may also include control system 48 in electrical communication with the encoder and with Human Machine Interface (HMI) 50. Control system 48 may be a processor, such as a microprocessor, which may include memory. As wheel 42 of rail idler wheel 40 travels along rail 100, encoder 44 data related to wheel 42 speed is recorded and communicated to control system 48. When compared with the transmission drive train speed (TDS), as measured from information derived from transmission drive train 60, as shown in FIG. 4, rail idler wheel 40 allows for an accurate relative difference that can be used in control system 48. Control system 48 can then control or otherwise govern engine speed to limit vehicle speed and control traction. FIG. 4 shows the connection of transmission drive train 60 in connection with flanged rail wheels 14.

Figure 3:
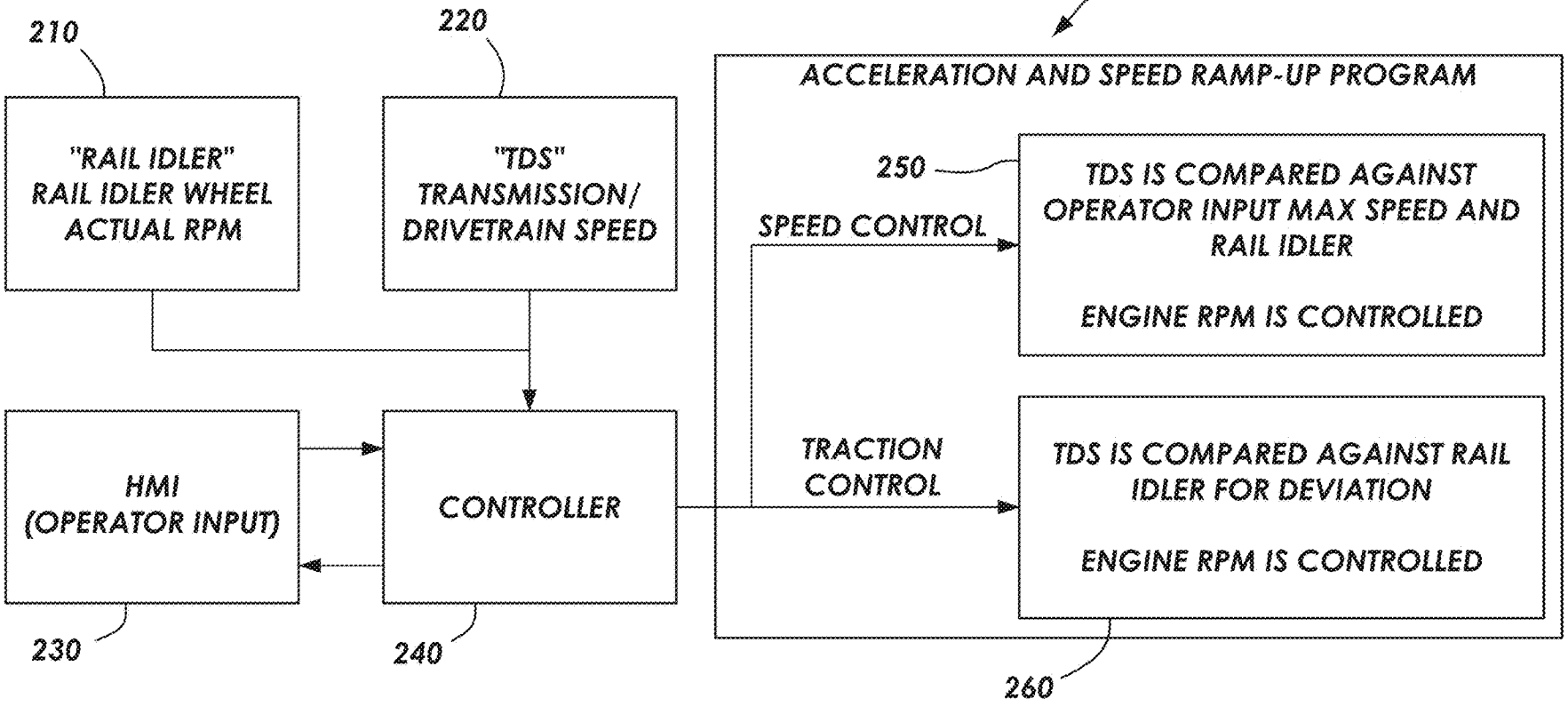
FIG. 3 is a flow diagram of performing speed control or traction control using a rail idler wheel consistent with certain embodiments of the present disclosure.

FIG. 3 depicts method of speed/traction control 200. In speed/traction control 200, the RPM of wheel 42 is measured at measure rail idler wheel 210 and communicated to control system 48. Further, transmission drive train speed (TDS) is measured at measure TDS 220 and communicated to control system 48. In certain embodiments, an operator may input limitations, such as a maximum speed limitation, through HMI 50 through input operator limitations 230. Following the receipt of operator limitations, control system 48 may implement RPM control 240 for engine rpm in either implement speed control 250 or implement traction control 260.

In implement speed control 250, TDS is compared to max speed input by the operator and RPM of wheel 42. If RPM of wheel 42 is above the max speed input by the operator, engine RPM is reduced until RPM of wheel 42 is below the max speed. If TDS and RPM of wheel 42 differ, engine RPM is decreased until convergence in TDS and RPM of wheel 42 is met. Such convergence may occur when flanged rail wheels 14 reduce or cease spinning in excess of needed rotation for the desired speed.

In implement traction control 260, TDS acceleration is compared to acceleration of RPM of wheel 42. If TDS acceleration and RPM acceleration differ, RPM is decreased until convergence in TDS acceleration and RPM acceleration of wheel 42 is met.

In certain embodiments, the controls algorithm manages detection of loss of contact between the wheel and comparison of detected vehicle speed with other data inputs to calculate vehicle speed and positioning relative to the track.

In some embodiments, control system 48 may be configured to receive data from blocks 210, 220, and 230, and perform the algorithm described by block 200. Specifically, control system 48 may be configured to receive data such as wheel 42 speed, for instance in RPMs and RPM acceleration, from encoder 44, maximum speed limitation from HMI 50, and transmission/drive train speed and acceleration from the transmission drive train. Control system 48 may then be configured to operate either in speed control mode or traction control mode. In control mode, control system 48 is configured to compare TDS against the maximum speed limitation and RPM of wheel 42. If RPM of wheel 42 is above the max speed limitation, control system 48 is configured to reduce engine RPM until RPM of wheel 42 is below the max speed limitation. If TDS and RPM of wheel 42 differ, control system 48 is configured to reduce engine RPM until TDS and RPM converge. In traction control mode, control system 48 is configured to compare TDS acceleration with acceleration of wheel 42. If TDS acceleration and acceleration of wheel 42 differ, the RPM of wheel 42 is decreased until TDS acceleration and acceleration of wheel 42 converge.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A railroad car moving vehicle comprising:
- a chassis frame;
- a platform, the platform mechanically connected to the chassis frame;
- flanged rail wheels, the flanged rail wheels coupled to the chassis frame;
- a cab, the cab positioned on the platform; and
- a rail idler wheel, the rail idler wheel connected to the chassis frame, the rail idler wheel including:
  - a wheel;
  - an encoder, the encoder in electrical communication with the wheel;
  - a support system, the support system mounting the wheel to the chassis frame; and
  - a control system, the control system in electrical communication with the encoder.

2. The railroad car moving vehicle of claim 1 further comprising ground wheel sets coupled to the chassis frame, the ground wheel sets including pneumatic rubber tires or foam filled tires.

3. The railroad car moving vehicle of claim 1, wherein the encoder is adapted to capture the speed in revolutions per minute of the wheel.

4. The railroad moving vehicle of claim 3, wherein the encoder is adapted to record the speed of the wheel and communicate the speed of the wheel to the control system.

5. The railroad car moving vehicle of claim 4, wherein the control system is adapted to control an engine speed of the railroad car moving vehicle based at least in part on the speed of the wheel.

6. The railroad car moving vehicle of claim 1, wherein the rail idler wheel further comprises a Human Machine Interface (HMI).

7. The railroad car moving vehicle of claim 6, wherein the HMI is adapted to receive an input of maximum speed of the railroad moving vehicle.

8. A method of controlling the speed of a railroad car moving vehicle comprising: supplying a railroad car moving vehicle, the railroad car moving vehicle including: a chassis frame; flanged rail wheels, the flanged rail wheels coupled to a transmission drive train; and a rail idler wheel, the rail idler wheel connected to the chassis frame, the rail idler wheel including: a wheel; an encoder, the encoder in electrical communication with the wheel; and a control system, the control system in electrical communication with the encoder; measuring revolutions per minute (RPM) of the wheel; measuring transmission drive speed (TDS); implementing RPM control by: a) comparing a maximum speed to the RPM of the wheel; if the RPM of the wheel is above the maximum speed, reducing an engine RPM until RPM of the wheel is less than is less than max speed; and if TDS and RPM of the wheel differ, decreasing engine RPM until convergence of TDS and RPM of the wheel is met; or b) computing TDS acceleration from TDS; computing acceleration of RPM of the wheel; comparing TDS acceleration and acceleration of RPM of the wheel; and if TDS acceleration and acceleration of RPM of the wheel are different, reducing the TDS RPMs until TDS acceleration and RPM acceleration have converged.

9. The method of claim 8, wherein the rail idler wheel includes a human machine interface (HMI).

10. The method of claim 9 further comprising entering the maximum speed through the HMI.

11. The method of claim 8 further comprising capturing the RPM of the wheel using the encoder.

12. The method of claim 11 further comprising recording the RPM of the wheel using the encoder.

13. The method of claim 12 further comprising communicating the RPM of the wheel to a control system.

14. A railroad car moving vehicle comprising: a chassis frame; a platform, the platform mechanically connected to the chassis frame; flanged rail wheels, the flanged rail wheels coupled to the chassis frame; a Human Machine Interface (HMI); and a rail idler wheel, the rail idler wheel connected to the chassis frame, the rail idler wheel including: a wheel; an encoder, the encoder in electrical communication with the wheel; a support system, the support system mounting the wheel to the chassis frame; and a control system, the control system in electrical communication with the encoder, and the HMI, wherein the control system is configured to: receive data such as wheel speed and acceleration from the encoder, maximum speed limitation from the HMI, and transmission/drive train speed and acceleration from a transmission drive train; operate either in speed control mode or traction control mode, wherein in speed control mode, the control system is configured to compare TDS against the maximum speed limitation and RPM of the wheel and if the RPM of the wheel is above the max speed limitation, reduce engine RPM until RPM of the wheel is below the max speed limitation and if TDS and RPM of the wheel differ, reduce engine RPM until TDS and RPM converge; and in traction control mode, the control system is configured to compare TDS acceleration with the acceleration of the wheel, wherein if TDS acceleration and acceleration of the wheel differ, the RPM of the wheel is decreased until TDS acceleration and acceleration of the wheel converge.

* * * * *